US009170566B2

(12) United States Patent
Fleury et al.

(10) Patent No.: US 9,170,566 B2
(45) Date of Patent: Oct. 27, 2015

(54) WATCH INCLUDING A FLANGE

(71) Applicant: ETA SA Manufacture Horlogere Suisse, Grenchen (CH)

(72) Inventors: Emmanuel Fleury, Moutier (CH); Pascal Lagorgette, Bienne (CH); Jean Laconte, Colombier (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/196,426

(22) Filed: Mar. 4, 2014

(65) Prior Publication Data

US 2014/0293758 A1 Oct. 2, 2014

(30) Foreign Application Priority Data

Mar. 28, 2013 (EP) ..... 13161515

(51) Int. Cl.

| | |
|---|---|
| ***G04G 17/06*** | (2006.01) |
| ***G04G 21/00*** | (2010.01) |
| ***G04G 17/04*** | (2006.01) |
| ***G04G 21/08*** | (2010.01) |

(52) U.S. Cl.

CPC ..... *G04G 17/06* (2013.01); *G04G 17/04* (2013.01); *G04G 21/00* (2013.01); *G04G 21/08* (2013.01)

(58) Field of Classification Search

CPC ..... G04G 17/06; G04G 21/00; G04G 21/08; G04G 17/04

USPC ..... 368/69, 276, 187, 296, 297

See application file for complete search history.

(56) References Cited

U.S. PATENT DOCUMENTS

| | | | | |
|---|---|---|---|---|
| 5,453,960 | A * | 9/1995 | Teres et al. | 368/69 |
| 5,742,564 | A * | 4/1998 | Kuschel et al. | 368/69 |
| 2002/0060953 | A1 * | 5/2002 | Farine et al. | 368/69 |
| 2002/0118605 | A1 * | 8/2002 | Born et al. | 368/69 |
| 2003/0039174 | A1 * | 2/2003 | Magnusson | 368/47 |
| 2004/0042346 | A1 * | 3/2004 | Mignot | 368/69 |
| 2006/0280040 | A1 * | 12/2006 | Bourban et al. | 368/296 |
| 2012/0099406 | A1 | 4/2012 | Lau et al. | |
| 2013/0201803 | A1 * | 8/2013 | Kaltenrieder et al. | 368/280 |

FOREIGN PATENT DOCUMENTS

| | | | |
|---|---|---|---|
| EP | 1 122 620 | A1 | 8/2001 |
| EP | 1 734 422 | A1 | 12/2006 |
| EP | 2 477 084 | A1 | 7/2012 |

OTHER PUBLICATIONS

English Machine Translation of EP2477084, translated Jan. 7, 2015.*
European Search Report issued Sep. 5, 2013, in European Application No. 13 16 1515 filed Mar. 28, 2013 (with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

Watch comprising a middle part which, with a crystal, delimits a watch case. The crystal includes a top face facing the user and an opposite bottom face facing the watch case. An electronic device is arranged on the bottom face of the crystal. A printed circuit board is disposed inside the watch case, underneath and remote from the electronic device. The watch includes a flange which is disposed between the crystal and the printed circuit board. The flange carries an electrical connection between the electronic device and the printed circuit board.

17 Claims, 1 Drawing Sheet

WATCH INCLUDING A FLANGE

This application claims priority from European Patent Application No. 13161515.5 filed 28 Mar. 2013, the entire disclosure of which is incorporated herein by reference.

FIELD OF THE INVENTION

The present invention concerns a watch including a flange. More specifically, the present invention concerns a watch including a means of electrical connection between an electronic device arranged underneath the watch crystal and a printed circuit board housed inside the watch case.

BACKGROUND OF THE INVENTION

In products such as the wristwatch marketed under the registered trademark T-Touch®, the electrical connection between the tactile keys structured on the bottom surface of the crystal and the printed circuit board is achieved by means of elastomer connectors, also known under the trade name of Zebra® connectors.

These elastomer connectors are formed of a series of alternate conductive and insulating layers typically made of elastomer. These elastomer connectors, which provide high-density connections for electrical paths, are typically disposed between the middle part of the watch and a flange which covers the edge of the dial and which conceals the elastomer connectors from the view of the watch user when the user examines his watch from the side.

Two components, namely an elastomer connector and a flange, are therefore necessary to ensure the electrical connection between the tactile keys and the printed circuit board.

Further, in order to totally conceal the elastomer connectors from the view of the watch user, it is also necessary to cover the peripheral edge of the crystal by means of a bezel or to print an opaque ink layer underneath the surface of the crystal. The bezel has the drawback of reducing the apparent aperture of the crystal and of increasing the thickness of the watch. This solution also has the drawback of not being very attractive, in particular in the case of ladies' watches. Likewise, printing an ink layer underneath the surface of the crystal also has the drawback of reducing the apparent aperture of the crystal. Further, it is difficult to match the print colour to that of the dial. Finally, if the crystal is viewed from the side, a discontinuity can be seen where the print is located.

SUMMARY OF THE INVENTION

It is an object of the present invention to overcome these drawbacks in addition to others by providing a watch including a means of electrical connection between an electronic device and a printed circuit board which is simpler and barely visible (or invisible) through the watch crystal.

The present invention therefore concerns a watch including a middle part which, with a crystal, delimits a watch case, the crystal including a top face facing the user and a bottom face facing the watch case, an electronic device being arranged on the bottom face of the crystal, a printed circuit board being arranged inside the watch case, underneath the electronic device and remote therefrom, the watch being characterized in that it includes a flange which is disposed between the crystal and the printed circuit board and carries a means of ensuring the electrical connection between the electronic device and the printed circuit board.

As a result of these features, the present invention provides a watch including a flange on which there is arranged a means of electrically connecting an electronic device secured underneath the watch crystal and a printed circuit board housed inside the watch case. It is therefore possible, by means of a single component, to combine functions which, in the prior art, were ensured by two separate components. Further, the electrical connection means is barely visible, or invisible through the watch crystal, and there is therefore no essential requirement to provide a bezel or a thick opaque ink layer to cover the peripheral edge of the crystal. The apparent aperture of the watch crystal is thus barely affected or not affected at all, so that it is possible to take advantage of virtually the entire surface of the watch dial, which means that either information can be displayed in larger dimensions, or more information can be displayed.

BRIEF DESCRIPTION OF THE DRAWINGS

Other features and advantages of the present invention will appear more clearly from the following detailed description of one embodiment of a watch according to the invention, this example being given solely by way of non-limiting illustration with reference to the annexed drawing, in which.

DETAILED DESCRIPTION OF THE INVENTION

The present invention proceeds from the general inventive idea which consists in providing a watch flange with a means of establishing an electrical connection between an electronic device arranged on a bottom surface of a watch crystal and a printed circuit board housed inside a watch case. The flange permits electrical contacts to be transferred from the electronic device arranged underneath the watch crystal to the printed circuit board disposed underneath and remote from the electronic device. It is therefore possible, using a single component, to combine functions which, in the prior art, were performed by two distinct components. Further, the top of the flange is practically invisible to the user's view, so that, if necessary, only a narrow strip of opaque ink needs to be printed along the edge of the crystal to conceal the flange. It is thus unnecessary to excessively reduce the apparent aperture of the watch crystal, which means that full advantage can be taken of the surface of the watch dial for displaying the necessary information.

As a result of these features, the present invention provides a watch including a flange on which there is arranged a means of electrically connecting an electronic device secured underneath the watch crystal and a printed circuit board housed inside the watch case. It is therefore possible, using a single component, to combine functions which, in the prior art, were performed by two separate components. Further, the electrical connection means is barely visible, or invisible through the watch crystal, and there is therefore no essential requirement to take steps to cover the peripheral edge of the crystal in order to conceal the connection means. The apparent aperture of the watch crystal is thus barely affected, so that it is possible to take advantage of virtually the entire surface of the watch dial, which means that either information can be displayed in larger dimensions, or more information can be displayed.

Figure 1:
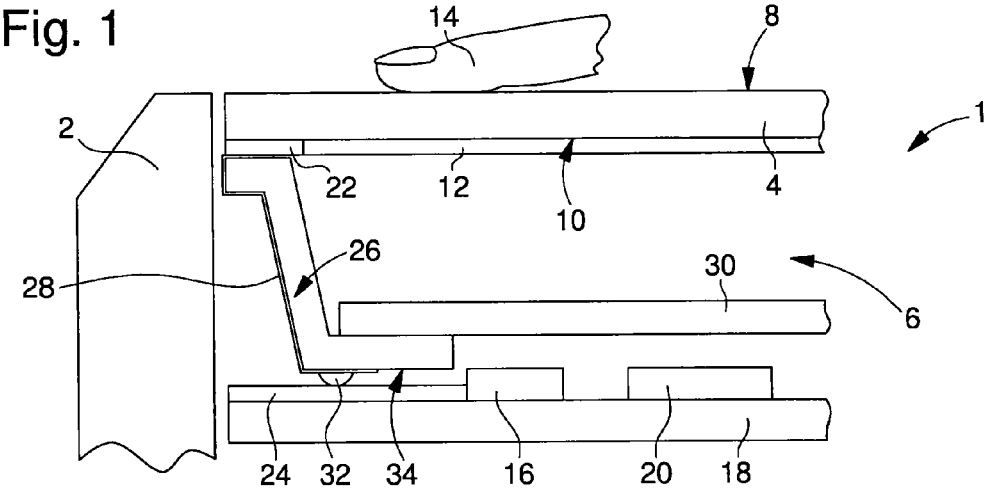
FIG. 1 is a cross-section of the watch according to the invention.

FIG. 1 is a cross-section of a watch according to the invention. Designated as a whole by the general reference numeral 1, this watch includes a middle part 2 which, with a watch crystal 4, delimits a watch case 6.

Watch crystal 4 has a top surface 8 facing the user of watch 1 and a bottom surface 10 facing the watch case 6. An electronic device is arranged on the bottom surface 10 of crystal 4. The electronic device may be any type of device. It may be a digital display device, for example a liquid crystal display, or (see FIG. 1) first conductive paths 12 made of a transparent electrically conductive material such as indium tin oxide, known as ITO. The purpose of these first conductive paths 12 is to form, on the surface of crystal 4, tactile keys which are sensitive to variations in capacitance and enable the user to enter instructions into an electronic tactile key control circuit 16 by means of a finger 14. This electronic control circuit 16 is mounted on a printed circuit board 18 housed inside watch case 6, underneath and remote from conductive paths 12. The assembly is supplemented by an electronic circuit 20 which controls the execution of a horological function or other function in accordance with instructions provided by electronic control circuit 16.

Conductive paths 12 define first electrical contact pads 22 which must be transferred from bottom face 10 of crystal 4 to printed circuit board 18. Printed circuit board 18 includes second electrical contact pads 24 which match first electrical contact pads 22 and are connected to electronic control circuit 16. As illustrated in FIG. 1, a generally circular flange 26 is provided for this purpose, arranged underneath crystal 4 of watch 1. This flange 26 is made of a non-electrically conductive material and includes a means which must ensure the electrical connection between the first and second electrical contact pads 22 and 24. In a preferred but non-limiting embodiment of the invention, this electrical connection means is formed by second conductive paths 28 which come into contact with first electrical contact pads 22 on the one hand, and with second electrical contact pads 24 on the other hand. The assembly is supplemented by a dial 30, for example made of metal, supported by flange 26.

Where flange 26 is made of a non-electrically conductive material such as a plastic, the second conductive paths 28 may be made for example by photolithographic structuring of an ITO layer. Second conductive paths 28 may also be made for example of copper, silver or aluminium using a method such as a laser treatment method for obtaining a moulded interconnect device or MID. Subsequently, the second conductive paths 28 are structured by an electroforming method. According to a variant, it is also possible to structure second conductive paths 28 on the surface of flange 26 by printing with an electrically conductive ink. It is also possible to envisage making flange 26 by a method of bi-injection of a plastic material and a conductive material followed by an electroforming step.

For an improved electrical contact between second conductive paths 28 and second contact pads 24, contact studs or bumps 32 may be structured on the bottom surface 34 of flange 26. It is also possible to envisage mounting the movement (not shown) of watch 1 in a pre-stressed manner so that the movement slightly forces flange 26 towards crystal 4 of watch 1. Likewise, the actual flange 26 may be mounted elastically pre-stressed to promote the electrical contact between second conductive paths 28 and first contact pads 22.

Figure 2:
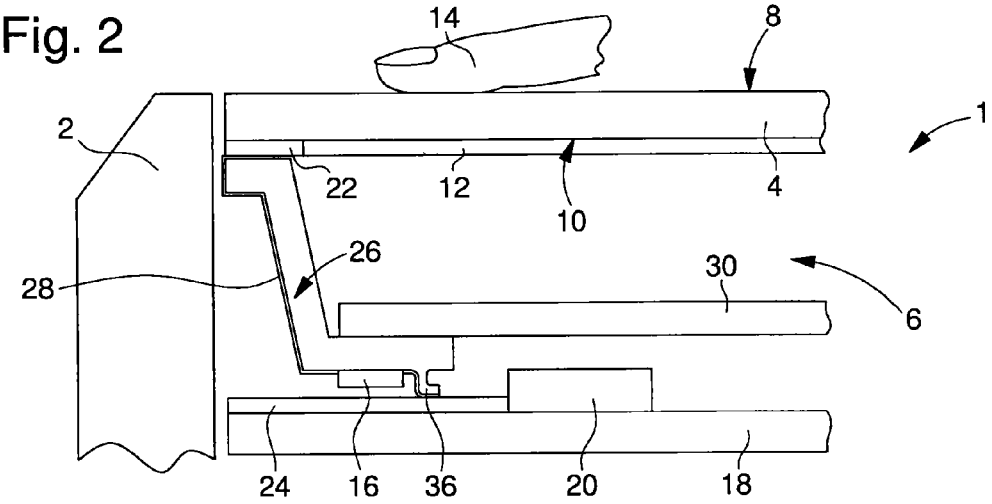
FIG. 2 is a similar view to that of FIG. 1, which illustrates a first variant embodiment of the watch according to the invention.

A variant embodiment of the invention is illustrated in FIG. 2, annexed to this Patent Application. It may happen that there is a large number of first electrical contact pads 22 defined by first conductive paths 12 underneath the surface of crystal 4, for example sixteen. It may then be difficult to place the sixteen conductive paths 28 of flange 26 directly in contact with second electrical contact pads 24 structured on printed circuit board 18. This is why electronic control circuit 16, whose input is directly connected to the sixteen conductive paths 28 of flange 26, is mounted directly on flange 26. Since the output of electronic control circuit 16 includes a maximum of four or five ports, namely two ports for the power supply and two or three ports for the multiplexing bus, it is easier to connect the outputs of electronic control circuit 16 rather than conductive paths 28 to the second electrical contact pads 24 of printed circuit board 18. The electrical connection between the outputs of electronic control circuit 16 and second electrical contact pads 24 is typically achieved by means of mechanical electrical contact elements 36, which may be integral with printed circuit board 18.

Figure 3:
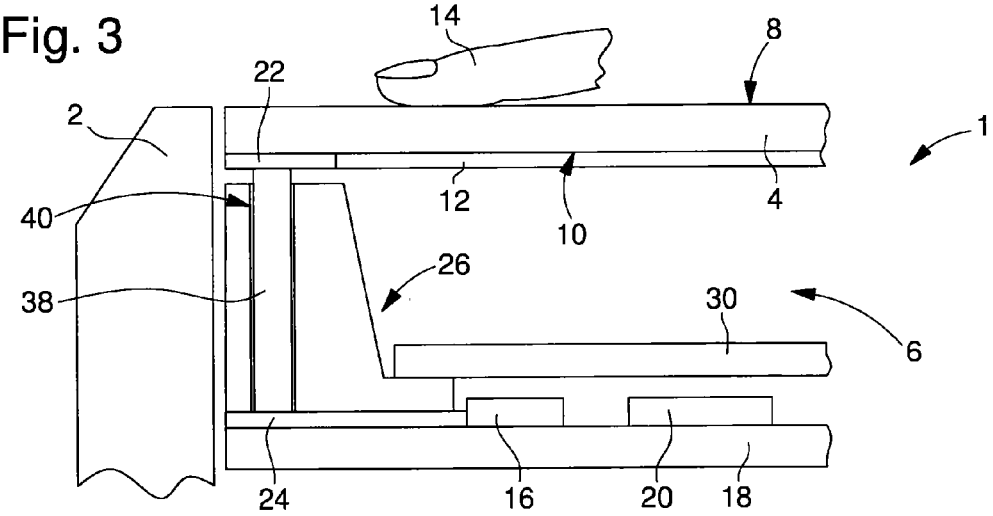
FIG. 3 is a similar view to that of FIG. 1, which illustrates a second variant embodiment of the watch of the invention.

A second variant embodiment is illustrated in FIG. 3, annexed to this Patent Application. According to this variant embodiment, the electrical connection means carried by flange 26 for ensuring the electrical connection between first conductive paths 12 which define tactile keys at the surface of crystal 4, and the second conductive paths structured at the surface of printed circuit board 18, are formed by elastomer connectors 38. These elastomer connectors 28, which extend between crystal 4 and printed circuit board 18, are guided and held by flange 26. Flange 26 therefore includes grooves 40 through which elastomer connectors 28 pass.

It goes without saying that this invention is not limited to the embodiments that have just been described and that various simple alterations and variants can be envisaged by those skilled in the art without departing from the scope of the claims annexed to this Patent Application. In particular, it will be clear that the electronic device arranged on the bottom surface 10 of crystal 4 may be a digital display device such as a liquid crystal display cell. The liquid crystal display cell includes a front substrate and a rear substrate extending parallel to and at a distance from each other and joined to each other by a sealing frame which delimits a sealed volume for confining the liquid crystal. The two front and rear substrates are arranged between first and second polarisers with intersecting directions of polarisation. The assembly formed by the two substrates and the two polarisers is bonded by means of a film of optical adhesive onto bottom surface 10 of crystal 4 of watch 1. The dimensions of the front substrate exceed those of the rear substrate. This forms a contact surface onto which the conductive paths emerge for the electrical connection of the display cell control electrodes to the electronic control circuit 20 of the cell. The electronic device arranged on bottom surface 10 of crystal 4 may also be a solar cell, for example formed of fine amorphous silicon strips, which are sufficiently fine and far apart to be invisible to the naked eye.

What is claimed is:

1. A watch comprising:

a middle part which, with a crystal, delimits a watch case, wherein the crystal comprises a top face facing the user and an opposite bottom face facing the watch case;

an electronic device arranged on the bottom face of the crystal;

a printed circuit board is disposed inside the watch case, underneath and remote from the electronic device;

a dial disposed between the crystal and the printed circuit board; and a flange which is disposed between the crystal and the printed circuit board and having a bottom part which extends inwardly and supports the dial by a peripheral edge thereof, wherein the flange carries an electrical connection between the electronic device and the printed circuit board.

2. The watch according to claim 1, wherein the flange is made of a non-electrically conductive material.

3. The watch according to claim 2, wherein the electrical connection includes one or more second conductive paths.

4. The watch according to claim 3, wherein the one or more second conductive paths are made of ITO, copper, aluminium or silver.

5. The watch according to claim 4, wherein the electronic device includes one or more first conductive paths which form one or more tactile keys.

6. The watch according to claim 5, wherein the first conductive paths define first electrical contact pads, which are transferred from the bottom face of the crystal to the printed circuit board, wherein the printed circuit board includes second electrical contact pads which match the first electrical contact pads, and wherein the second conductive paths come into contact with the first electrical contact pads, and with the second electrical contact pads on the other hand.

7. The watch according to claim 6, wherein an electronic control circuit, one input of which is connected to the second conductive paths, is mounted on the flange, an output of the electronic control circuit being connected to the second electrical contact pads of the printed circuit board.

8. The watch according to claim 4, wherein the electronic device includes a digital display device or a solar cell.

9. The watch according to claim 3, wherein the electronic device includes one or more first conductive paths which form one or more tactile keys.

10. The watch according to claim 9, wherein the first conductive paths define first electrical contact pads, which are transferred from the bottom face of the crystal to the printed circuit board, wherein the printed circuit board includes second electrical contact pads which match the first electrical contact pads, and wherein the second conductive paths come into contact with the first electrical contact pads, and with the second electrical contact pads on the other hand.

11. The watch according to claim 10, wherein an electronic control circuit, one input of which is connected to the second conductive paths, is mounted on the flange, an output of the electronic control circuit being connected to the second electrical contact pads of the printed circuit board.

12. The watch according to claim 3, wherein the electronic device includes a digital display device or a solar cell.

13. The watch according to claim 2, wherein the electronic device includes a digital display device or a solar cell.

14. The watch according to claim 2, wherein the electrical connection carried by the flange to ensure the electrical connection between the electronic device and the printed circuit board is formed by elastomer connectors which extend between the crystal and the printed circuit board and which are guided and held by the flange passing through grooves arranged in the flange.

15. The watch according to claim 1, wherein in the electronic device includes a digital display device or a solar cell.

16. The watch according to claim 1, wherein the electrical connection carried by the flange to ensure the electrical connection between the electronic device and the printed circuit board is formed by elastomer connectors which extend between the crystal and the printed circuit board and which are guided and held by the flange passing through grooves arranged in the flange.

17. The watch according to claim 1, wherein the flange has a predetermined dimension which sets a distance between the crystal and the printed circuit board.

* * * * *